United States Patent [19]

Woodgate

[11] Patent Number: 5,067,906

[45] Date of Patent: Nov. 26, 1991

[54] ELECTRIC CURRENT DISTRIBUTION APPARATUS

[75] Inventor: Terence A. Woodgate, London, England

[73] Assignee: GTE Rotaflex Limited, London, England

[21] Appl. No.: 623,413

[22] PCT Filed: Jun. 15, 1989

[86] PCT No.: PCT/GB89/00665

§ 371 Date: Dec. 7, 1990

§ 102(e) Date: Dec. 7, 1990

[87] PCT Pub. No.: WO89/12918

PCT Pub. Date: Dec. 28, 1989

[51] Int. Cl.[5] ..... H01R 17/04

[52] U.S. Cl. ..... 439/115; 439/530; 439/675; 439/700; 362/226

[58] Field of Search ..... 439/110, 115, 210, 214, 439/638, 675, 529, 530, 576, 116–119, 207, 120, 209, 212, 213, 216, 527, 542, 543, 642, 664, 667, 700, 824; 362/226; 285/907

[56] References Cited

U.S. PATENT DOCUMENTS 3,416,125 12/1968 Theue ..... 439/638

FOREIGN PATENT DOCUMENTS 241318 10/1987 European Pat. Off. .
86191446 2/1987 Fed. Rep. of Germany .
87072823 8/1987 Fed. Rep. of Germany .
3611594 10/1987 Fed. Rep. of Germany .

*Primary Examiner*—Gary F. Paumen
*Attorney, Agent, or Firm*—Watson Cole Grindle & Watson

[57] ABSTRACT

An electrical connector (cable rod) comprising coaxial conductors and coupling means at each end thereof to enable the cable rod to be connected releasably but securely end-to-end with another substantially identical cable rod to form a rigid cable rod assembly, with electrical continuity of the inner and outer conductors being maintained over the length of the assembly, the inner conductor including a contact portion at one end retractable against a spring force exerted thereon to ensure firm axial abutment with the inner conductor of another cable rod coupled to said one end.

25 Claims, 4 Drawing Sheets

ELECTRIC CURRENT DISTRIBUTION APPARATUS

BACKGROUND OF THE INVENTION

This invention relates generally to electric current distribution apparatus, and is concerned especially, but not necessarily exclusively, with devices and equipment for a low voltage distribution track system and lighting installations.

SUMMARY OF THE INVENTION

In accordance with one aspect the invention relates particularly to electric cables of rigid construction and finite length so that they take the form of stiff rods capable of providing firm support for an electrical device, such as a distribution track, appliance e.g. light fitting, or the like, to which the cable may also supply electric current. For convenience such cables are referred to herein as "cable rods", (electrical connectors), and the embodiments described in detail below are specifically adapted for low voltage electric current supply applications In accordance with the first aspect of the invention there is provided the invention resides in a cable rod (electrical connector) comprising coaxial conductors and coupling means at each end thereof to enable the cable rod to be connected releasably but securely end-to-end with another substantially identical cable rod to form a rigid cable rod assembly, with electrical continuity of the inner and outer conductors being maintained over the length of the assembly, the inner conductor including a contact portion at one end retractable against a spring force exerted thereon to ensure firm axial abutment with the inner conductor of another cable rod coupled to said one end.

In one embodiment the contact portion is provided by a pin urged axially outwardly with respect to an axially fixed conductor rod by a spring interposed therebetween. According to another embodiment the inner conductor comprises a rod extending continuously from one end to the other end of the conductor, the contact portion being an end of the rod, and a spring being arranged to bias the rod longitudinally in the direction towards said end.

The invention also provides a coupling unit for use with the cable rods of the invention, the coupling unit comprising a body, coupling means of essentially the same or complementary form at either end of the body to enable the unit to be connected between two cable rods in axial alignment, a contact at each end of the unit for engaging the inner conductor of a cable rod attached to that end, spring means accommodated in the body and acting on the contacts to urge them away from each other. In a preferred construction the contacts are connected by a flexible conductor, e.g. a braided conductor, to ensure good electrical continuity therebetween, and the body is made in two relatively rotatable parts to enable rotational coupling unit relative to the cable rod secured to the opposite end of the coupling unit.

In accordance with another aspect the invention relates to an electrical coupling for an electric distribution track. The coupling of the invention is suitable for supplying electric current to a track and/or taking current off from the track, e.g. by a cable rod as aforementioned, for supply to an appliance or another track section.

Electric distribution tracks are well known and generally comprise elongate channels along which elongate conducts extend. A supply connector is fitted to the track channel, most frequently at one end of a track length, for connecting the track to a source of electric power. Other connectors, commonly known as "adaptors", can be engaged with the track at any position along its length for connecting electric appliances, usually but not necessarily light fittings, to the track. The adaptors are designed to provide mechanical support for the light fittings, so that they are supported by the track. The most common arrangement is for a track to be supported below a ceiling and for the light fittings to be suspended beneath the track, but other arrangements are possible. By tradition the supply connectors and adaptors tend to be of different constructions in view of their differing duties, although they do fit together with the same track. Hitherto supply connectors and adaptors have been of relatively complicated designs with bodies of insulating material carrying contacts for engagement with the track conductors and means to ensure mechanical securement with the track channel. In recent years there has been a trend towards low voltage track lighting systems and in some cases the channel configuration for the track has been abandoned, which has been made possible because the need for the conductors to be concealed is removed as there are no shock hazards with low voltage systems. Nonetheless, the supply connectors and adaptors have remained of relatively complicated construction.

Provided in accordance with the present invention there is an electric track coupling of elegantly simple yet highly effective design for a low voltage distribution system. A coupling embodying the invention comprises a track length including a member defining a channel with an inner wall and two side walls having means defining inwardly facing abutment shoulders extending along the channel, a conductor extending along and supported by-the inner wall, a connector having a screw threaded tubular part, a contact pin projecting through the tubular part, and a thread element received in the track channel in engagement with the abutment shoulders, said element having threaded engagement with the tubular part and causing the contact pin to be pressed into firm engagement with the track conductor. It will be appreciated that such a coupling requires a minimum number of components and each is of uncomplicated design.

BRIEF DESCRIPTION OF THE DRAWINGS

A better understanding of the invention in its various aspects will be gained from the following detailed description of some specific embodiments, reference being made to the accompanying drawings, in which.

DETAILED DESCRIPTION OF THE INVENTION

Figure 1:
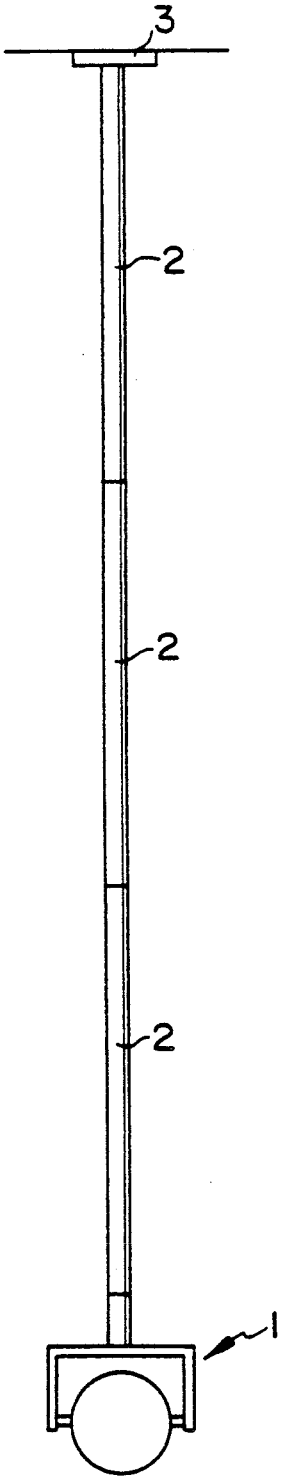
FIG. 1 shows schematically a light fitting suspended from a ceiling by an assembly of cable rods.
Figure 2:
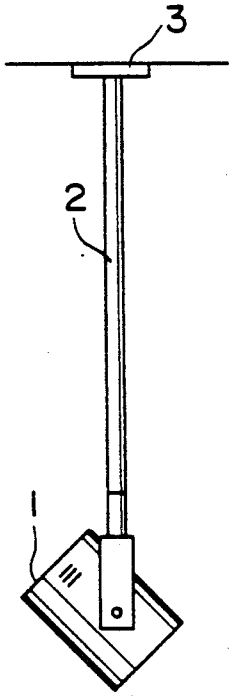
FIG. 2 is a similar view of a light fitting supported by means of a single cable rod.

In FIG. 1, a light fitting 1 is shown suspended from a ceiling by means of a rigid rectilinear support formed by a string of three cable rods (electrical connectors) 2 connected end-to-end. The upper end of the cable rod string is secured to a suitable socket 3 to provide the necessary electrical connections and mechanical support, and the lower end of the string is connected to a suitable coupling provided on the light fitting 1. It will be appreciated that the length of the support can be selected by increasing or reducing the number of cable rods used, and to allow greater choice over the length of the string, cable rods of different lengths may be provided. FIG. 2 also shows a light fitting 1 suspended from a ceiling socket 3, in this case by a single cable rod 2. As will become clear from the description which follows, the cable rods have male and female screw threaded couplings at their respective ends enabling them to be screwed together end-to-end and to be threadedly engaged with the sockets 3 and fittings 1 to provide the necessary mechanical connection and with the electrical connections being completed automatically upon screwing the parts together. The cable rods of the invention can be used for other applications besides those shown in FIGS. 1 and 2 and they may be employed with particular advantage in electric track distribution systems in which the cable rods may be used to support and supply current to a track length as well as to support an appliance, such as a light fitting, from the track so that it is powered from the track. In such installations the cable rods may be coupled to the track by means of the coupling arrangement described in more detail below and shown in FIGS. 7 to 9.

Figure 3:
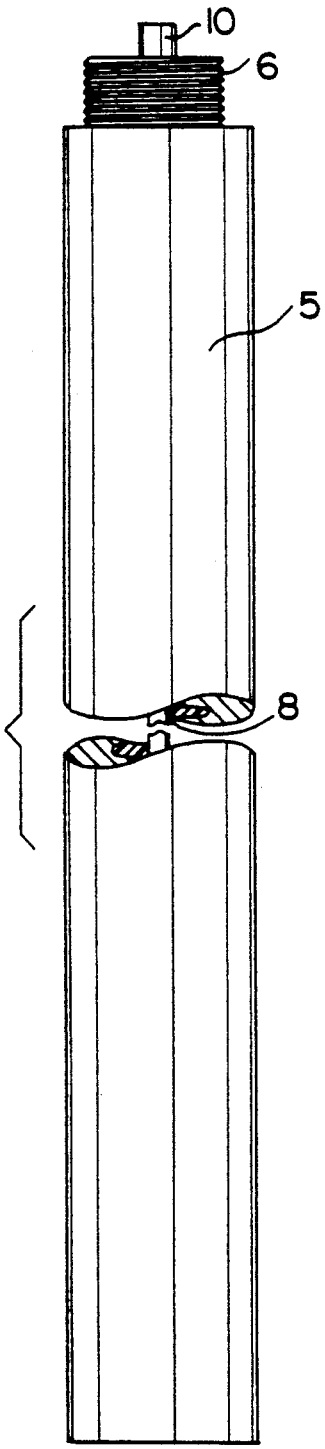
FIG. 3 is a side elevation of a cable rod.
Figure 4:
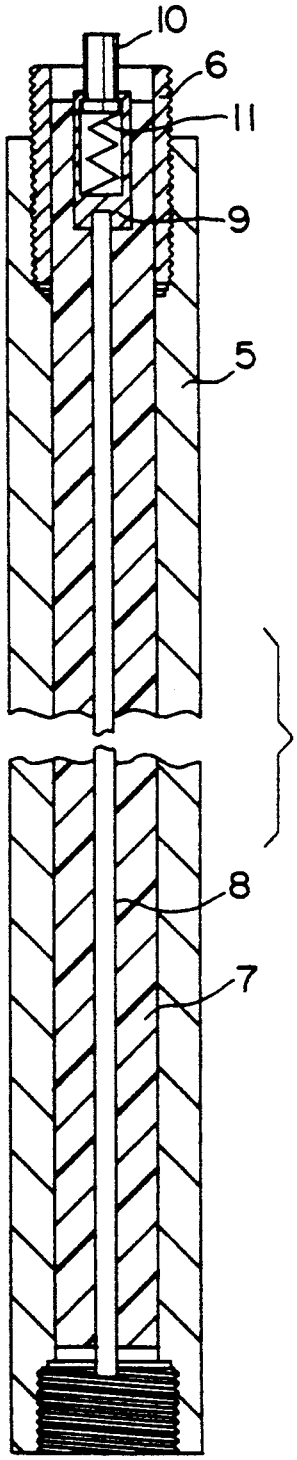
FIG. 4 shows the cable rod of FIG. 3 in axial cross section.

Turning to FIGS. 3 and 4 there is shown an exemplary embodiment of a cable rod 2 having coaxial conductors. The outer conductor comprises a metal tube 5 which is internally screw threaded at both ends, and an externally threaded bush 6 screwed into one end of the tube. The bush projects from the tube to form a male coupling while the opposite end of the tube defines a female coupling or socket adapted to receive the male coupling of another identical cable rod. The inner conductor is held axially within the outer conductor by a layer of insulation 7, and the inner conductor comprises a metal rod 8 extending from the socket, into which it protrudes a little to form a contact pin, to a spring pin assembly which includes a cylindrical cup 9 having its base fixed to the end of rod 8, a metal pin 10 having an enlarged head held captive by an inturned flange on the cup 9, and a coil spring 11 interposed between the base of the cup and the pin for urging the pin to an outermost position (as shown) in which it projects beyond the insulation 7 and the end of bush 6.

When the cable rod is screwed together end-to-end with another rod of the same form, the pin 10 bears against the exposed end of the inner conductor rod 8 of the second rod and becomes pushed back into the cup 9 as the threaded joint is screwed up tight. In this way firm abutting contact is ensured between the inner conductors to ensure their electrical continuity along the length of the cable rod assembly, such continuity of the outer conductors being similarly ensured by the conductive bush and abutment between the ends of the metal tubes 5. Any number of cable rods can be connected together to form a cable rod string of required length.

Figure 5:
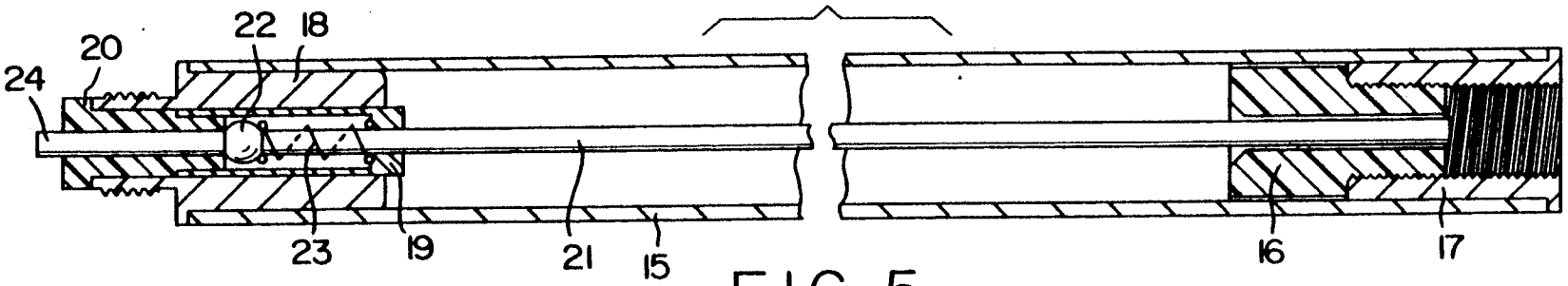
FIG. 5 is an axial section through a second embodiment of a cable rod.

A modified cable rod is shown in FIG. 5. It has an outer metal tube 15 into one end of which is inserted a insulating spacer 16 allowed by an internally screw threaded bush 17. To secure the spacer in the tube it has a spigot which is screwed into the inner end of the bush 17. Inserted into the other end of tube 15 is a metal plug 18 formed with an externally threaded boss and having an axial through bore accommodating a spring housing 19 and an insulating sleeve 20. The sleeve 20 has a flange in abutment with the end of the boss and serves to close the end of the spring housing. A stiff metal rod or bar 21 extends continuously through the length of the cable rod with one end exposed in the female socket defined by bush 17 and the other end projecting beyond sleeve 20 to define a contact pin 24. At a position within the spring housing the rod 21 is provided with a spring abutment 22, conveniently formed by flattening a short section of the rod. A coil spring 23 surrounds the bar and acts between the inner end of the spring housing and the abutment 22 to urge the latter against the sleeve 20. By providing a continuous unitary inner conductor electrical continuity through the cable rod is more easily ensured. When the male coupling of the cable rod is screwed into the socket of another similar rod, the inner conductor of the latter engages the protruding pin 24 and pushes it inwardly against the force of the spring 23, the whole inner conductor in this case being displaced longitudinally.

With the cable rod as shown in FIG. 5 it may be desirable, in order to avoid having to maintain very tight manufacturing tolerances, to provide in a device connected to the socket at the end of a cable rod or string of a cable rods means for taking up the longitudinal movement of the inner conductor. For example such means could be included in a connection part of a light fitting or in a ceiling socket. Alternatively, it could be incorporated in a separate connection device e.g. for connecting the cable rod to a socket, light fitting, distribution track or the like. The means in question may take the form of a pair of contacts electrically interconnected by a flexible conductor such as a braided wire conductor, and a spring urging the contacts apart. The end of the inner conductor of the cable rod will be arranged to press on one contact which will move towards the other contact against the spring action to take up the excess projection length of the cable rod conductor.

Figure 6:
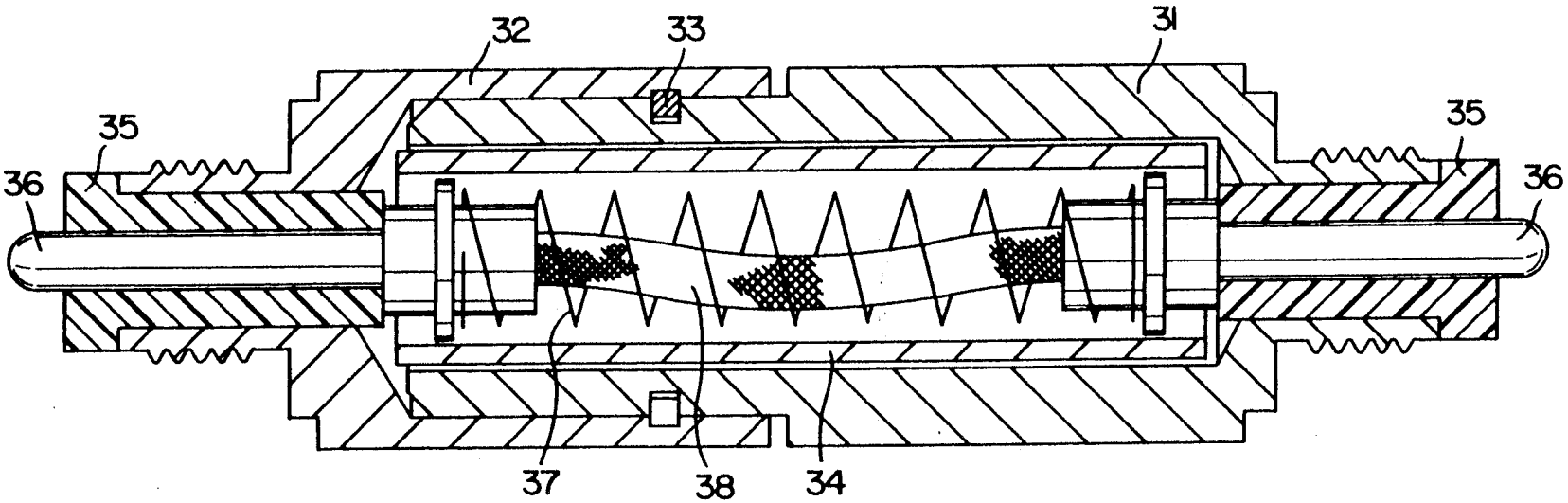
FIG. 6 is an axial cross section through a rotating coupling unit or adaptor for use with the cable rod of FIG. 5.

A device which combines the function of such a means and a rotary coupling unit is shown in FIG. 6.

This device, which will be referred to as an adaptor, has at each end a male coupling of substantially the same form as that of the cable rod shown in FIG. 5, allowing either or both ends of the adaptor to be connected to cable rods with the adaptor being capable of accommodating the displacement of their inner conductors. The adaptor has a two-part housing, an inner end of one part 31 being telescoped into the inner end of the other part 32, with a circle 33 holding the two parts axially together so that they are relatively rotatable. A generally cylindrical chamber within the housing is lined by a sleeve 34 of insulating material. The threaded boss of each housing part is fitted with an insulating insert 35 through which a pin contact 36 passes, the contact having an enlarged head which abuts the insert 35 to limit outward movement of the contact, and a collar on the head providing an abutment shoulder for one end of a spring 37 which urges the contacts apart. The contacts are interconnected by a flexible, braided wire conductor 38. Each pin contact can slide inwardly against the action of the spring under a force applied against the outer tip, and hence the adaptor will absorb the longitudinal displacement of the inner conductors of cable rods secured to the adaptor. The electrical continuity is completed by the housing 31, 32 for the outer conductors and by the contacts 36 and flexible wire 38 for the inner conductors. Furthermore, by virtue of its split housing the adaptor enables axially rotative adjustment of a device or cable rod attached to one side of the adaptor relative to the cable rod or device attached to the other side of the adaptor, and such rotation may be continuous as there are no stops, which can be of benefit such as when adjusting the beam direction of a light fitting supported by the adaptor. A further advantage of the adaptor is that it allows male couplings to be located at both ends of a cable rod assembly, which simplifies the connections of the assembly to devices at both ends thereof.

It will be appreciated that a device, such as a light fitting, could be constructed to incorporate a connector including a rotatable coupling of essentially the same form as the adaptor of FIG. 6, but in that case one housing part 31, 32 may be fixed to the light fitting and means other than a pin may be used for electrical connection to the corresponding contact 36 of the assembly.

Figure 7:
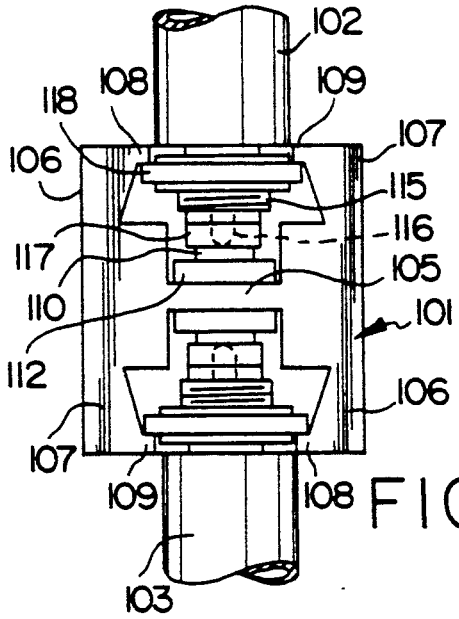
FIG. 7 is an end view of an electric track coupling embodying the invention.
Figure 8:
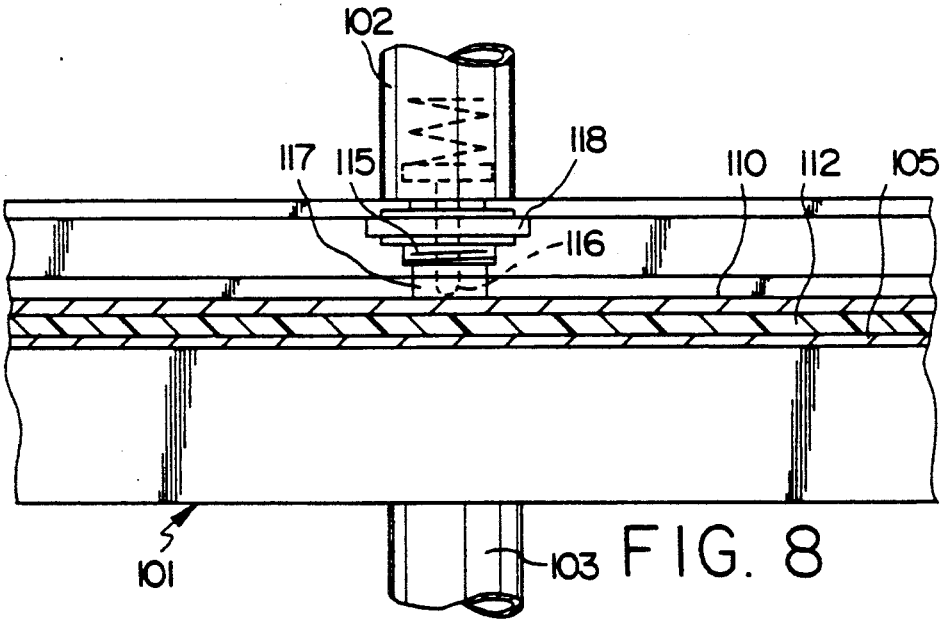
FIG. 8 is a side view of the coupling shown in FIG. 7 with the track shown partly in cross section.
Figure 9:
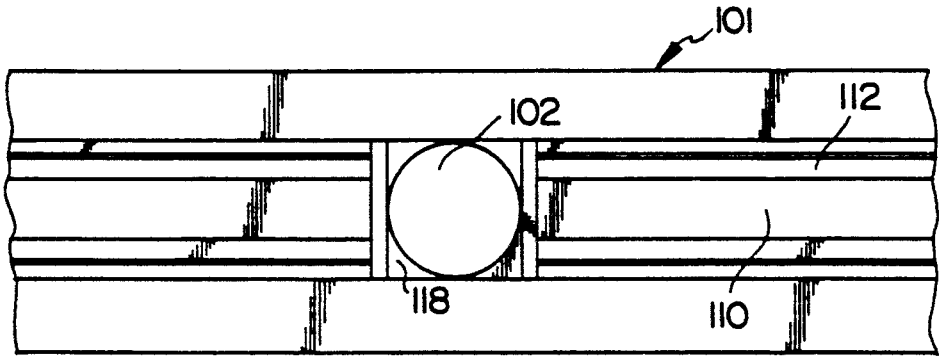
FIG. 9 is a top plan view of the coupling in FIG. 7.

It should be noted that the male couplings of the cable rod shown in FIG. 5 and the adaptor shown in FIG. 6 are of suitable design to enable connection to a distribution track by a coupling assembly as shown in FIGS. 7 to 9.

The electrical coupling illustrated in these Figures forms part of a low voltage distribution system including a length of track 101, a member 102 for supplying electric current to the track and supporting the track, e.g. from a ceiling, and a similar member 103 for connecting a light fitting, or other appliance, both electrically and mechanically to the track so that it is supported by and powered from the track. The track 101 is of double channel configuration and shaped symmetrically with respect to a medial, horizontal plane. Each channel includes an inner end wall formed by a transverse web 105, and a pair of opposed side walls 106, 107 each of which is undercut to form inturned lips or flanges 108, 109 at the sides of the channel mouth. Supported on the inner wall of the channel and electrically isolated therefrom by a strip 112 of insulating material is a conductor 110. The track is of uniform cross section along its length and at a convenient location, such as at one end, the two conductors 110 are connected together by a bridging element extending through or around the edge of the web 105. The main body of the track is conductive, e.g. made of aluminium and serves as the second conductor of the track for transmitting electric power.

Each member 102, 103 may consist of a rigid cable rod or a rotation joint as described hereinabove. Projecting at the end of the member 102, 103 is an externally threaded tubular part or sleeve 115 which also constitutes a first contact. A second contact is provided by an axial pin 116 projecting through and beyond the sleeve 115 to make contact with the track conductor 110. The pin 116 is spaced from the outer contact 115 by an insulating sleeve 117 which has an enlarged head at its outer end in abutment with the end of the contact 115. The pin 116 is spring loaded and normally projects a little beyond the end of the insulator sleeve 117. Screwed onto the threaded contact 115 is a square nut 118 which on both sides and on all four edges is rebated to define a central land on each side. The land is dimensioned to be received non-rotatably between the track lips 108, 109 while the shoulder surfaces at opposite edges of the nut engage the abutment shoulders defined by the lips. It will be appreciated that the shape of the nut means that it can be inverted and fitted either way round in the track, whereby correct assembly of the coupling is facilitated.

With the nut unscrewed to the edge of the contact 115, the nut can be introduced into the track channel by a tilting movement of the member 102, 103. The member 102, 103 is then rotated so that the nut 118 is driven into firm abutment with the track lips 108, 109 while the reaction force acts to clamp the insulator 117 against the conductor 110. The pin contact 116 retracts due to its spring loading but is still pressed against the conductor 110. Consequently, the outer contact 115 is connected to the main body of the track through the nut 118, and the pin 16 connects directly to the conductor 110, good contact pressure being ensured in both cases by the clamping action produced by the threaded connection of the nut on the contact 115.

The clamping action secures the conductor rod 102, 103 rigidly to the track with the rod extending at right angles from the track so that firm support is ensured either for the track itself when carried by the rod 102 or for an electric appliance when carried from the track on the rod 103.

The described electrical coupling is of simple construction, but it is also easy to assemble and is effective in use. In addition it can be used for both current supply and take-off connections. Furthermore, all the connection parts are housed within the track channel so that the visual appearance is improved.

It should be understood that in an electrical distribution system the or each track member 101 may be carried by two or more supporting rods 102 spaced apart along the track member, but not all of these supporting rods are necessarily used for current supply purposes.

I claim:

1. An electrical cable consisting of an elongate rigid rod and comprising inner and outer coaxial conductors and complementary coupling means comprising male and female screw-threaded couplings at the opposite ends thereof, thereby to-enable the connector to be connected releasably but securely end-to-end with another connector of substantially identical form to construct a rigid coaxial connector assembly with electrical continuity of the inner and outer conductors being maintained over the length of the assembly, the inner conductor including at one end of the connector a contact portion retractable axially relative to the outer conductor against a spring force exerted thereon, whereby to ensure firm axial abutment of said contact portion with the inner conductor of another connector coupled to said one end of the connector.

2. A electrical connector according to claim 1, wherein said contact portion is located at the end of said male coupling.

3. An electrical connector according to claim 1, wherein the outer conductor comprises a metal tube and the inner conductor is spaced from the tube by insulating material.

4. An electrical connector according to claim 3, wherein the male coupling is formed by a threaded part secured into and projecting from one end of the metal tube.

5. An electrical connector according to claim 3, wherein the insulating material extends continuously along the connector.

6. An electrical connector according to claim 3, wherein members of insulating material are spaced apart along the length of the connector.

7. An electrical connector according to claim 1, wherein the contact portion is a pin, he inner conductor includes an axially fixed part, and a spring means is interposed between said fixed part and said pin to urge the pin axially outwardly.

8. An electrical connector according to claim 7, wherein the spring means is located in a spring housing and said spring housing limits the outward movement of the pin.

9. An electrical connector according to claim 3, wherein the female coupling comprises an internally screw threaded sleeve fixed in the end of the metal tube.

10. An electrical connector according to claim 9, wherein the insulating material comprises separate insulating spacers spaced apart along the connector, one said spacer being secured to said threaded sleeve.

11. An electrical connector according to claim 10, wherein said one spacer is threadedly connected to said sleeve.

12. An electrical connector according to claim 1, wherein the inner conductor comprises a stiff unitary element, an end of said element constituting said contact portion.

13. An electrical connector according to claims 12, wherein conductor element has an abutment and spring means acts between said abutment and a confronting, axially fixed shoulder.

14. An electrical connector according to claim 13, wherein said contact end portion is received slidably in an insulating spacer, and said abutment engages the spacer to limit the movement of the conductor element under the action of the spring means.

15. An electrical connector according to claim 13, wherein said abutment is an integral projection on said conductor element.

16. An electrical connector according to claim 13, wherein the spring means is accommodated in a spring housing having said axially fixed shoulder thereon.

17. An electrical connector according to claim 13, wherein the spring means comprises a coil spring surrounding the conductor element.

18. An assembly for supporting an electrical device on a structure and supplying electric current to said device, comprising at least two substantially identical electrical connectors as defined in claim 1.

19. In combination, a coupling device, and an electrical connector as claimed in claim 1, said coupling device comprising a housing having coupling means for cooperation mechanically and electrically with a coupling means of the connector, contacts spaced apart longitudinally of the housing and interconnected by a flexible conductor, and spring means arranged within the housing to urge the contacts apart.

20. The combination according to claim 19, wherein the housing has a respective coupling means at each end thereof.

21. The combination according to claim 20, wherein the two coupling means are of the same form.

22. The combination according to claim 21, wherein each coupling means comprises a screw-threaded male connector.

23. The combination according to claim 21, wherein the housing comprises two parts connected for rotation relative to each other.

24. The combination according to claim 19, wherein an insulating sleeve is received in the housing and said spring means and flexible conductor are positioned within the sleeve.

25. The combination according to claim 19, wherein the flexible conductor is a braided wire conductor.

* * * * *